US005954210A

United States Patent [19]

Kullmann et al.

[11] Patent Number: 5,954,210

[45] **Date of Patent: *Sep. 21, 1999**

[54] TRANSLOADING APPARATUS FOR TRANSCONTAINERS

[75] Inventors: Friedemann Kullmann, Hannover; Burkhard Mende; Andreas Baumann, both of Essen, all of Germany

[73] Assignee: Krupp Fordertechnik GmbH, Duisburg, Germany

[ * ] Notice: This patent is subject to a terminal disclaimer.

[21] Appl. No.: 08/938,729

[22] Filed: Sep. 26, 1997

Related U.S. Application Data

[63] Continuation of application No. 08/424,423, Apr. 21, 1995, Pat. No. 5,727,702.

[30] Foreign Application Priority Data

Sep. 1, 1993 [DE] Germany ..... 43294707
Dec. 14, 1993 [DE] Germany ..... 43425224

[51] Int. Cl.[6] ..... B65C 19/00

[52] U.S. Cl. ..... 212/273; 212/319; 414/460

[58] Field of Search ..... 414/626; 212/272, 212/273, 318, 319, 335, 344

[56] References Cited

U.S. PATENT DOCUMENTS

| | | | |
|---|---|---|---|
| 1,569,269 | 1/1926 | Eagleston | 212/319 |
| 3,655,081 | 4/1972 | Monk | 212/344 |
| 4,124,133 | 11/1978 | Rosin et al. | 212/335 |
| 4,256,230 | 3/1981 | Clark et al. | 212/344 |
| 4,273,242 | 6/1981 | Schaper | 212/273 |
| 5,727,702 | 3/1998 | Kullmann et al. | 212/273 |

FOREIGN PATENT DOCUMENTS

| | | | |
|---|---|---|---|
| 1248885 | 8/1967 | Germany | 212/256 |
| 3636459 | 4/1988 | Germany | 212/318 |
| 1221193 | 3/1986 | U.S.S.R. | 212/318 |
| 1324991 | 7/1987 | U.S.S.R. | 212/272 |

*Primary Examiner*—Thomas J. Brahan
*Attorney, Agent, or Firm*—Herbert Dubno

[57] ABSTRACT

The invention relates to a transloading apparatus for transcontainers such as freight containers, interchangeable containers and semi-trailers including a crane trolley adapted to travel on a crane or portal, to which, by way of a lifting means, a load receiving means is fitted in a manner for raising and lowering.

In order to enable the load receiving means to be guided and aligned more accurately in relation to the transcontainer, provision is made to connect to the load receiving apparatus two horizontally movable columns or lifting structures at a distance from one another which is fixed or can be adjusted in a defined manner and to render these vertically displaceable. Preferably each of the columns or each of the two lifting structures can be connected by way of a pendulum suspension to the load receiving means.

10 Claims, 7 Drawing Sheets

TRANSLOADING APPARATUS FOR TRANSCONTAINERS

Figures 1A, 1B, 1C:
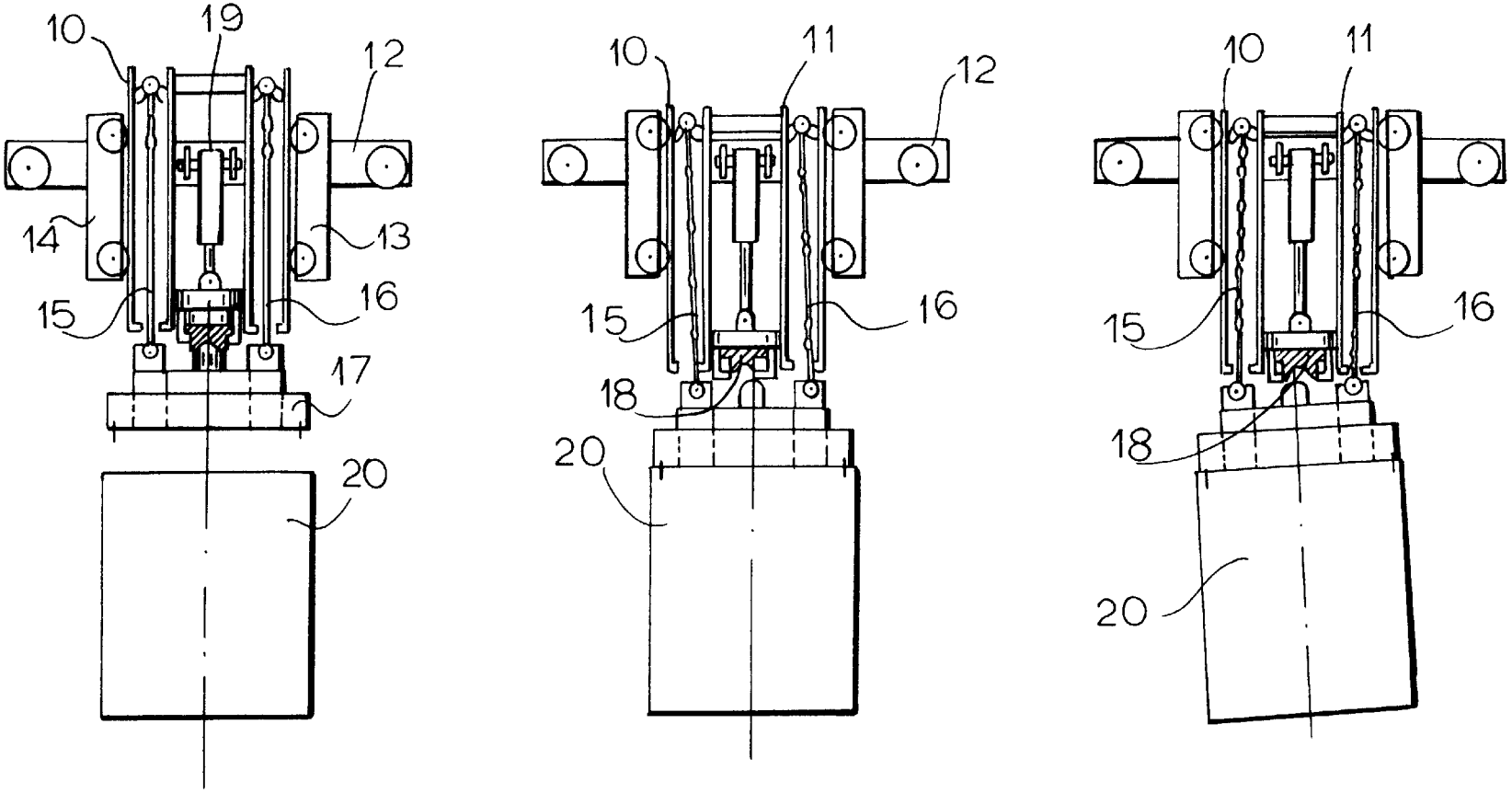

This application is a continuation of Ser. No. 08/424,423 filed Apr. 21, 1995 (now U.S. Pat. No. 5,727,702 issued Mar. 17, 1998).

That application is a national phase of PCT/EP94/02711 filed Aug. 13, 1994 based upon German national applications P 4329470.7 of Sep. 1, 1993 and P 43 52 522.4 of Dec. 14, 1993 under the International Convention.

The invention relates to a transloading apparatus for transcontainers such as freight containers, interchangeable containers and semi-trailers including a crane trolley adapted to travel on a crane or portal, to which, by way of a lifting means, a load receiving means is fitted in a manner for raising and lowering.

The aforesaid transcontainers serve as freight containers, for example for goods which have not been packaged or only lightly packaged and which may, in part, be moisture sensitive or for the formation of larger loading units. Such transcontainers not only save packaging material, but they also increase transloading rates.

According to the state of the art, gripping means for container transloading are known which are referred to as spreaders and which can be equipped with additional interchangeable pallet pincers. For picking up containers the spreaders have so-called twist locks by means of which the containers can be gripped from above. For picking up interchangeable containers and semi-trailers gripping claws are provided which can grip into the grapple rebates provided on the underside of the said containers. The adjustment of the twist locks to the various container lengths may proceed in the spreader by way of telescope means. After the twist locks have engaged into the load receiving points of the container or of the claws into the grapple rebates of the interchangeable containers or semi-trailers, these transcontainers jointly with the entire lifting and transportation means are lifted by means of lifting ropes. The lifting ropes are passed over pulleys fitted above to the lifting and transporting means, for example a portal crane. Bearing in mind the demand for short transloading times the lifting and the horizontal movements frequently cause the transcontainer to be set into pendulum motion, whereby an accurate guidance and setting down is rendered impossible. In practice, damping of the pendulum movements is attempted by oblique pulling of the lifting ropes.

With particular regard to a fully automatic transloading of transcontainers in combined load traffic and shortening the crane travel distances, increasing the cycle times per transloading as well as shortening the length of the installation, it is endeavored to perform loading and unloading from and onto a travelling train. An automatic setting down of the load units onto the train including aligning the grapple means in respect of the transcontainers and automatic release of the grapple means from the transcontainer is a precondition therefor.

A need exists to so further develop the transloading apparatus referred to in the introduction that the load receiving means can be accurately guided and aligned in relation to the transcontainer.

The present invention provides a transloading apparatus as set out in Claim 1, wherein two horizontally displaceable columns or lifting structures are connected to the load receiving means side by side at a distance from one another which is fixed or can be adjusted in a defined manner and that at least one of the two lifting structures can be displaced vertically.

The spacing of the columns or lifting structures is selected as far apart as possible and as far as possible above the load receiving points so as to provide the largest possible base for receiving and fixing the transcontainer even in the event of an off-centre gravitational centre of the load unit and tensile forces applied to the lifting structure or the lifting means there provided can be maintained which are at least approximately of equal magnitudes.

The vertical displaceability of at least one of the two lifting structures, preferably both columns or lifting structures provides the facilities which enable the lifting structures to be aligned optimally in relation to transcontainers in an inclined position.

Although a rigid connection between the transcontainer and the lifting means offers the advantage that pendulum movements are prevented from the outset, this nevertheless involves the drawback that relative movements between the vehicle to be unloaded, e.g. a rail carriage and the transcontainer which has already been grappled, are not possible. In view of the fact that the transcontainer on the one hand is coupled rigidly to the lifting means of the transloading apparatus and on the other hand is also restrained by the positioning pins on the carriage or by abutment against. a second load unit, gives rise to major constraining forces which may result either in damage to the transloading apparatus, the vehicle such as the carriage or to the transcontainer. In order to overcome this drawback, it is proposed according to a further development of the inventive concept that each of the two columns or each of the two vertically displaceable lifting structures is connected to the load receiving means by way of a pendulum suspension. The pendulum suspension which, according to a working example of the invention, may comprise a centering pin and a seat means is preferably arrestable. The pendulum suspension of the load receiving means by eliminating the rigid load guidance affords yieldability to the grappling means. Depending on the nature of the pendulum suspension a relative movement can be afforded with an optional number of up to all six degrees of freedom, permitting positioning errors or skew positioning of the trancontainer to be compensated for. However, the pendulum suspension should preferably be permitted only during loading and unloading, i.e. the picking up of the load and the depositing of the load, for which reason during transporting of the picked up transcontainer by the transloading apparatus the pendulum suspensions is blocked in that the transcontainer is rigidly connected to the lifting structures. The rigid connection inhibits the dreaded pendulum movements during transport and permits an increased transportation velocity. At the same time the arresting permits centering the transcontainer in relation to the transloading apparatus respectively the lifting structures.

Any structures known in the art can be used as the load receiving means, in particular a spreader, preferably a telescopic spreader or a walking beam. As an alternative to these single component load receiving means it is possible to employ a plurality of walking beams, grappling arms or grappling beams, preferably coupled together, of which each is connected to a single lifting structure. For example, two grappling beams each having two pivoting pins for container transloading and two grappling arms for interchangeable containers and semi-trailers may be used of which each is fitted to one of the two lifting structures.

Preferred embodiments of the pendulum suspensions are defined in Claims 6 to 8. Thus, the pendulum suspension in the simplest situation may comprise ropes and/or pendulum rods.

When using pendulum rods these, according to a further embodiment of the invention, are provided at each end with ball and socket or cardanic linkages which provide for a free pendulum and evasive movement. The pendulum suspensions in or from the lifting structures are vertically movable, more particularly being each separately vertically movable, so that an adaptation of the position is automatically brought about even when the transcontainers stand skew in that during setting down the pendulum rods are upwardly displaced. When using a rope a compensation is brought about by rope slack formation.

According to a further embodiment the lifting structures are each mounted in a crane trolley where they can be separately moved not only vertically but also transversely to the longitudinal axis of the transcontainer. It is thereby made possible to also grapple such transcontainers which have been turned skew about the vertical axis. This is so because by mutual transverse displacement the load receiving means such as the spreader can be turned.

The aforedescribed construction offers the advantage that positioning errors or skew positioning of the transcontainer during loading and unloading can be compensated for. On the other hand for rapid loading and unloading operations with a moving train, an exact guidance of the load receiving means, for example spreader is necessary which is as rigid as possible. Disadvantages of a rigid suspension arise in the event of relative movements between the carriage or other transport means to be unloaded and the load unit which has already been gripped. If the load unit on the one hand is rigidly coupled to the crane and on the other hand is still restrained by the positioning pins on the carriage or by leaning against a second load unit, high constraining forces may arise which can result in damage to the crane, transport means or the load unit. In order to permit an accurate guidance of the load receiving apparatus in relation to the transcontainer to the same extent as providing for the avoidance of pendulum movements during the lifted transportation of the transcontainer by the transloading apparatus, the transloading apparatus according to the invention comprises pendulum rods which in their lower region close to where the load is picked up, or whereof the load receiving means are guidable by virtue of adjustment units. By means of these adjustment units it is possible to temporarily abolish the normally advantageous rigid load guidance in order to compensate for minor positioning errors or skew positioning of the load units in relation to the load receiving unit. As soon as centering of the transcontainer in relation to the load receiving means has been brought about the transcontainer can be rigidly coupled to the load receiving means.

Since the load receiving means by way of the adjustment units are additionally pivotal about a vertical axis it is possible not only to compensate for translatory displacements in the horizontal plane or (by way of the suspensions of the pendulum rods) skew positioning, but also for positionings displaced about a vertical axis by a pivoting angle. Preferably the load receiving means can be guided by way of the adjustment means in three degrees of freedom.

In order to be able to provide adequate guidance for the load receiving means in relation to the pendulum rods, a further embodiment of the invention provides at least three adjustment units, preferably four adjustment units, the arrangement of which permits not only translatory movements in three dimensions but also pivotal movements about a vertical axis. For this purpose, according to a further embodiment of the invention, four pendulum rods are provided which each are coupled to an adjustment unit, at least two of the adjustment units, viewed in plan view being in vertical relationship to one another. In this manner it is possible to apply as uniform a compressive or tensile force as possible between the pendulum rods and the load receiving means at the points of attack.

In order to avoid additional arresting means a further embodiment of the invention provides that the adjustment means can be arrested in optional extended positions. This embodiment permits "freezing" the adjustment means after having been aligned in their position in order for the lifting transport to provide rigid coupling whereby pendulum movements are avoided.

In accordance with a further embodiment of the invention the adjustment means includes an integrated distance measuring means which, in conjunction with the control regulating means permits a fine alignment for the grappling and setting down procedure.

The pressure limiting valves which are preferably provided in the adjustment units permit limiting the transverse forces arising from the horizontal accelerations of the crane trolley and/or portal to a maximum.

Altogether, by the employment of the adjustment means it is possible not only to damp pendulum movements of the load unit but also to perform fine position adjustments of the load receiving means in relation to the transcontainer. This obviates having to accurately align the crane trolley or the portal. Accordingly, the masses to be accelerated are reduced, furthermore, the positioning accuracy increased because of the low adjustment velocities of the adjustment units and the correspondingly reduced forces which are needed for bringing about movement.

Any constructions according to the state of the art may be employed as load receiving means, in particular a spreader, preferably a telescope spreader or a walking beam.

As an alternative to these single component load receiving means may serve a plurality of walking beams, grapple arms or grapple beams, preferably coupled together, of which each is connected to only one lifting structure. For example, two grappling beams with two pivoting pins each for container transloading and two grappling arms for interchangeable containers and semi-trailers may be used of which each is fitted to one of the two lifting structures.

The pendulum rods are each provided at their end with ball or universal joints whereby a free pendulum or evasive movement can be provided. The pendulum suspensions in or on the lifting structures are vertically displaceably fitted, in particular are each separately vertically displaceably fitted, so that positional adjustments are automatically brought about even in the event of transcontainers in a skew position by virtue of the pendulum rods being displaced upwardly during the setting down procedure.

According to a further embodiment, the lifting structures are each installed in a crane trolley where they are separately movable not only vertically but also transversely to the longitudinal axis of the transcontainer. Thereby it becomes possible to grapple even those transcontainers which are in a skew position turned about the vertical axis. The reason is that the load receiving means during mutual displacements transversely can be turned like a spreader, permitting fine adjustments to be carried out by way of the aforesaid adjustment units.

The crane trolleys may be supported on one or two bridge, half or full portal cranes, the crane trolleys preferably being adapted to be moved jointly by way of a synchronising control. According to a further embodiment of the invention the crane trolleys may also each be fitted to a separate crane between which the longitudinal spacing is adjustable so that by adjusting the longitudinal spacing of the cranes, the load receiving means, composed of two grapple beams can be adjusted to the particular length of the transcontainer. In order to be able to adapt the grappling arms or grappling beams also to load units which are skew about all three axes, it is possible to employ in addition a connection of the two grappling beams or arms by way of a torsionally rigid and non-flexible element which adapts to the spacing of the grappling beams, such as a telescope beam. This element only serves to couple the pivotal degrees of freedom of the two grappling beams so that these will e.g. always lie in planar relationship on the roof surface of the transcontainer. Here as well it is possible to perform fine adjustments way of the said adjustment units.

Optionally the crane trolleys may additionally be interconnected by a coupling rod, preferably a telescope coupling rod, particularly if the load pick-up proceeds not by two separate grappling beams but by a rigid spreader.

In order to position and fix the adjustment units several possibilities arise:

The adjustment units may be mounted on both sides in articulation eyelets on a pendulum rod and on the lifting structure or the pendulum rods are guided by guide gates to uncouple the adjustment movements in both planes which are normal to one another, the adjustment units being fitted rigidly to the lifting structure.

In a final modification, the adjustment cylinders are fitted in articulation eyelets on one side to the lifting structure and on the other side to the spreader. This offers the advantage that no transverse force acts onto the pendulum rod.

Working examples of the invention are illustrated in the Figures.

Figure 2A:
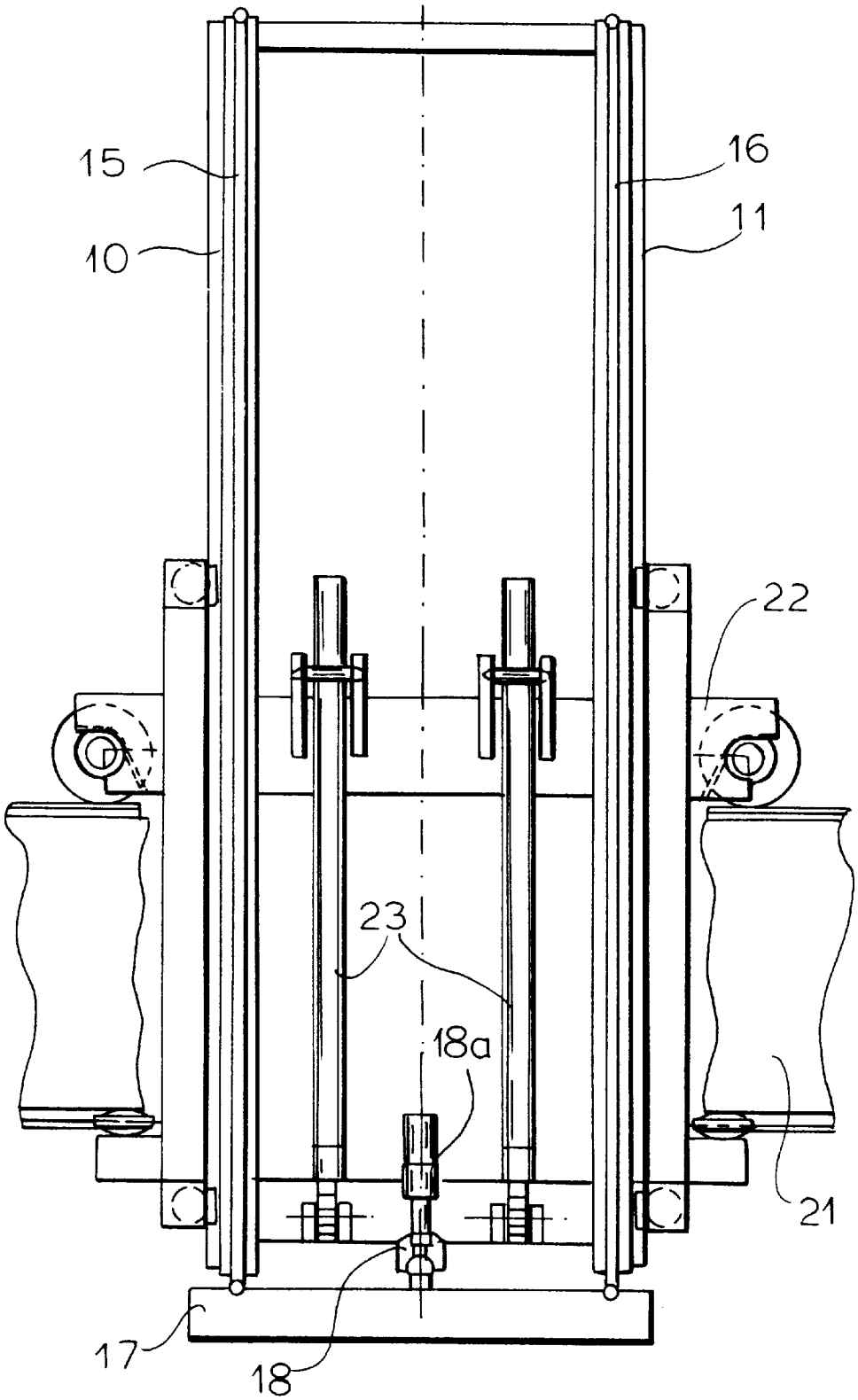
Figure 2B:
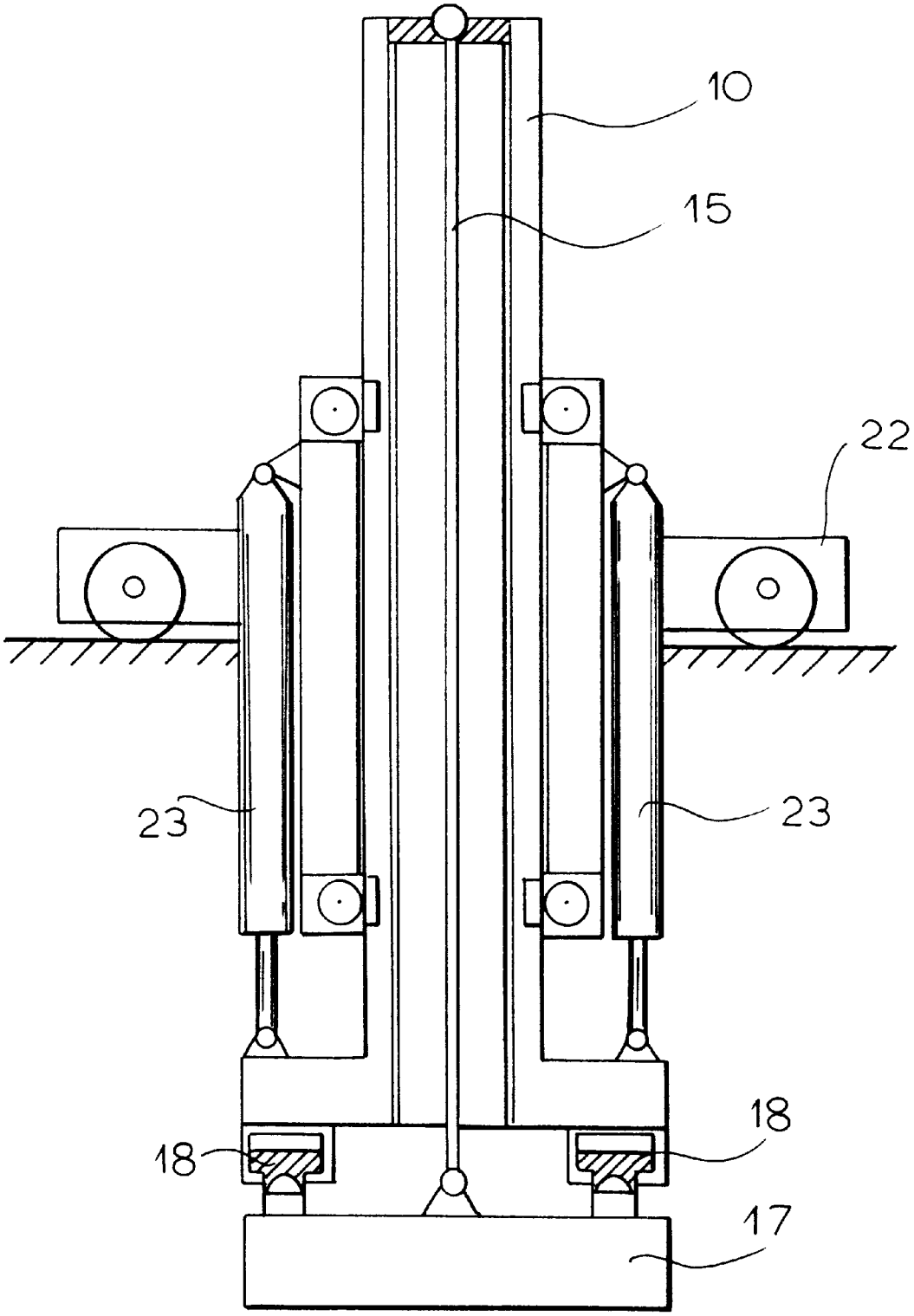
Figure 3:
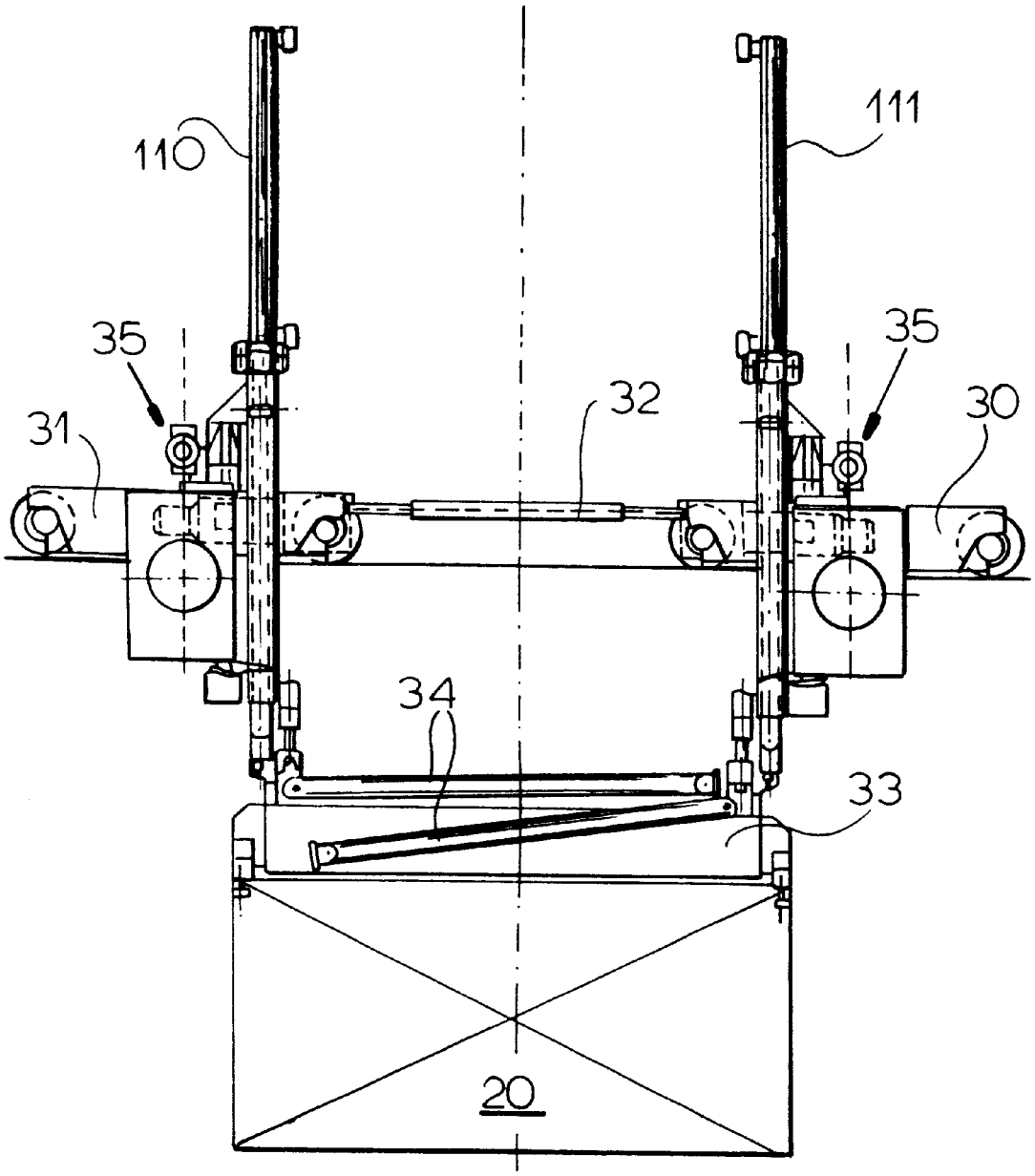
Figure 4:
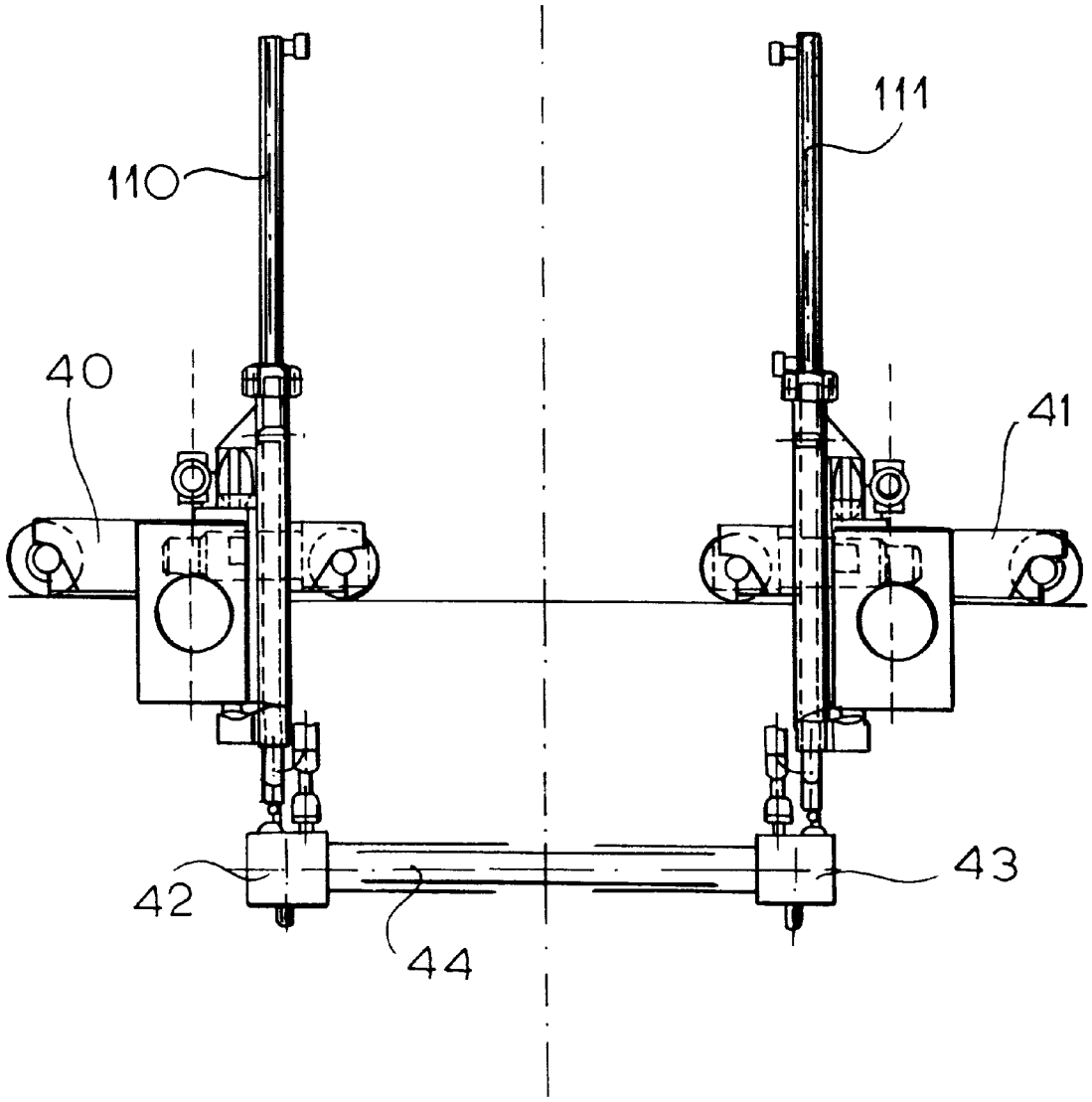
Figure 5C:
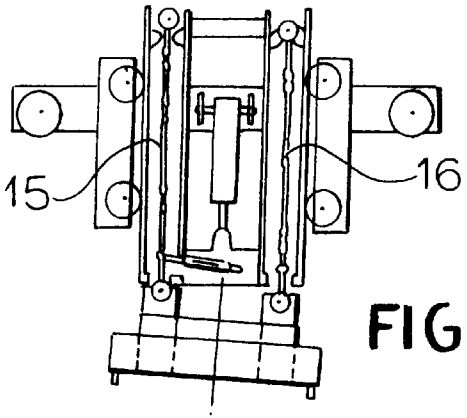
Figure 5D:
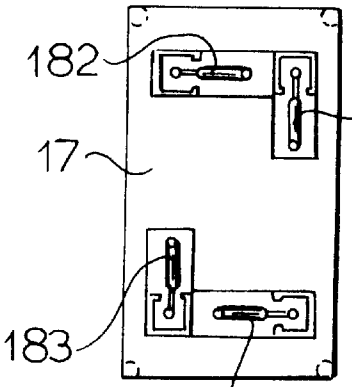
Figure 5B:
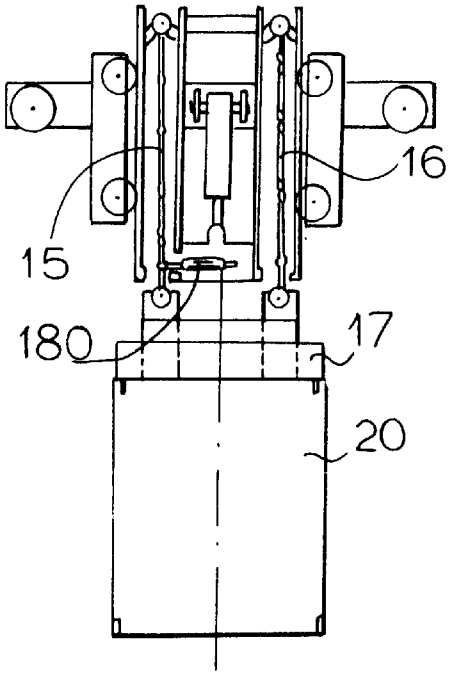
Figure 5A:
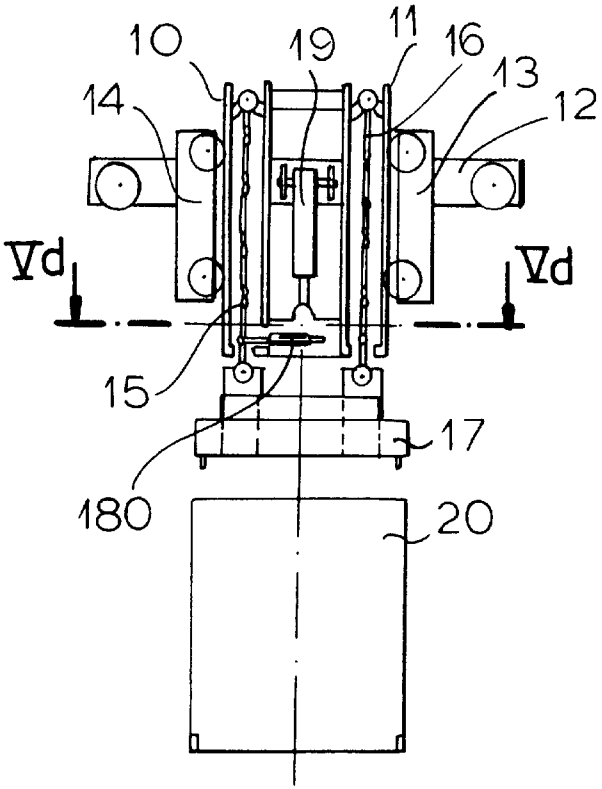
Figure 6A:
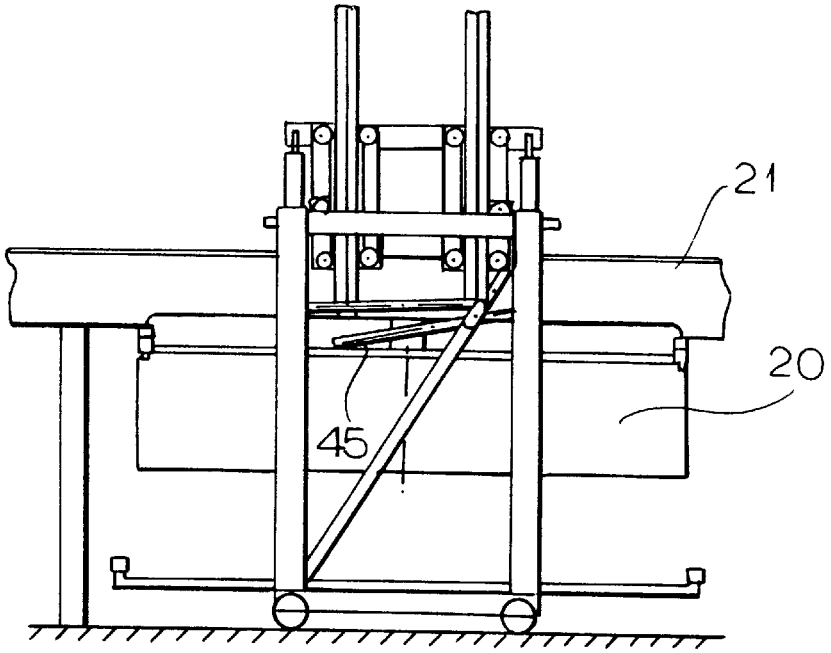

There is shown in:

FIG. 1*a* to *c* in each a schematic front view of the transloading apparatus in relation to a transcontainer in various operative positions, FIG. 2*a* an embodiment of the transloading apparatus including a single rail trolley having a rigid lifting structure from which two pendulum rods are cardanically suspended, FIG. 2*b* a further embodiment including a single pendulum rod on the lifting structure, FIG. 3 two portal cranes which are interconnected by way of a coupling rod and which manipulate a telescope spreader, FIG. 4 two separate bridge cranes having lifting structures and lifting beams suspended from pendulum rods and interconnected by way of a non-flexible telescope, FIGS. 5*a* to *c* in each a schematic section through a transloading apparatus in relation to a transcontainer in different operative positions, FIG. 5*d* a plan view along the section line A—A according to FIG. 5*a*, and FIGS. 6*a, b* in each a section through a dual-rail trolley having rigid lifting structure on a crane bridge in different views.

The transloading apparatus according to the invention comprises essentially a lifting structure including two columns 10 and 11 interconnected by at least one transverse beam. The lifting structure is vertically movable in a crane trolley 12 by virtue of a linear guide system 13, 14. The two columns 10 and 11 are each represented by box profiles in each of which a pendulum rod 15 and 16 is cardanically mounted. At the lower free end of the pendulum rod 15, 16 a load receiving means 17 is fitted likewise by way of cardanic mountings. The interconnected columns 10 and 11 are moreover connected to an arresting means 18 formed, for example, by a pin mounted on the load receiving means 17 suspended from the pendulum means, and an appropriately shaped rebate connected to the lifting structure.

The rebate may be rendered movable by way of a lifting cylinder 18*a* (see FIG. 2).

The lifting means 19 provided on the trolley 12 serves for raising and lowering the lifting structure.

In the illustration according to FIG. 1*a* the arresting means 18 is locked to the load receiving means 17, for example, so as to be able to adjust an optimal position by way of suitable control and reusing systems when moving the transloading apparatus into the pick up position in relation to the transcontainer 20. Undesirable pendulum movements of the load receiving means in relation to the lifting structure can be avoided effectively. If the arresting means is released it is possible, as shown in FIG. 1*b*, to bring about a horizontal alignment of the spreader serving as load receiving means 17 by aligning the pendulum rods 15 and 16. After coupling the transcontainer 20 to the spreader 17 and slightly lifting the latter, the pendulum rods are swung by gravity again into the vertical position in which the arresting means 18 can be locked. After releasing the locking means 18 it is possible also to securely couple transcontainers 20 in a skew position in accordance with FIG. 1*c* in the course of which one of the pendulum rods—in this case pendulum rod 16—during setting down is automatically displaced upwardly. The lifting structure may be raised and lowered by virtue of the drive means fitted to the trolley 12.

The transloading apparatus according to FIG. 2*a* shows on a box beam 21 of a crane a single rail crane trolley 22, the lifting structure comprising two columns 10 and 11 and to the upper end of which the pendulum rods 15 and 16 are cardanically suspended, as in the case of the embodiment of FIGS. 1*a* to 1*c*, is fitted to the crane trolley 22. Likewise the load receiving means 17 is fitted to the pendulum rods 15 and 16 by way of a cardanic linkage. In addition the lifting structure comprises a hydraulic cylinder 18*a* to the free end of which a receiving formation for a pin connected to the load receiving means 17 is fitted and forms an arresting means 18. In the present case two hydraulic cylinders 23 serve for raising and lowering the load receiving means 17 or the transcontainer 20 respectively.

However, it is equally possible to provide a column 10 or lifting structure with a single pendulum rod only, connected to the load receiving means 17. In that case, two arresting means 18 are provided which each laterally engage the load receiving means 17. Such embodiments are particularly practical in a modification in which two lifting structures each comprise a pendulum rod and four arresting means.

In the case of the transloading apparatus according to FIG. 3, two bridge crane trolleys 30 and 31 interconnected by way of a coupling rod 32 and which manipulate a telescope spreader 33 are provided. Grappling arms 34 by means of which interchangeable containers for semi-trailers can be picked up are swung upwards in the present case. The drive means 35 of the bridge crane trolleys are synchronised with one another. Due to the separate vertical displaceability of the lifting structures 110 and 111 it is possible for each lifting structure to be lifted appropriately in accordance with a skew position of the transcontainer 20. Where the positioning is diagonally skew, a further compensation therefore is possible by way of yielding pendulum suspensions.

In the transloading apparatus according to FIG. 4, the respective lifting mechanisms 110 and 111 are vertically movably provided in separated bridge cranes 40 and 41. Lifting beams 42 and 43, interconnected by a non-flexible and torsionally rigid telescope rod 44 to provide coupling for transmitting the rotary degrees of freedom are suspended from pendulum rods by way of a universal joint linkage.

The transloading apparatus illustrated in FIGS. 1 to 4, operates as follows for receiving and transporting a container with a spreader serving as load receiving means:

When horizontally moving the transloading apparatus, i.e. during travelling into the picking up position, the spreader 17 is fixed horizontally in relation to the lifting structures 10 and 11 in relation to the arresting means 18 (FIG. 1*a*). Shortly before the spreader 17 settles onto the transcontainer 20, the locking is released. The spreader 17 will then settle with released locking means, i.e. being horizontally and optionally vertically freely movable, onto the container and is locked thereto. After lifting the container 20 from the vehicle, the spreader 17 is once again interlocked for further transport with the lifting structures 10 and 11.

Similar procedures are followed when setting down the transcontainer 20, i.e., travelling proceeds with the spreader 17 locked. After reaching the setting down position, the locking between the spreader 17 and the lifting structures 10 and 11 is first released before the container is set down and the locking between the spreader 17 and the container 20 is released. Afterwards the spreader is raised and again interlocked with the lifting structure 10, 11.

The transloading apparatus according to the invention is useful particularly for combined loading traffic with changing load units. Due to the guidance of the spreader being alternatingly rigid during transport or the pendulum suspension is released, optimal provision may be made for different operating positions.

In the case of the transloading apparatus according to the invention as shown in FIGS. 5*a* to *d*, each of the four pendulum rods 10 and 11, provided in that case has in its lower region an articulated servo-cylinder 180 serving as an adjustment unit or (see FIG. 5*d*) 181 to 184 the one end of which is connected to the pendulum rods 15 or 16 and the second end of which is connected to the load receiving means 17. The lifting means 19 fitted to the crane trolley 12 serves for raising and lowering the lifting structure. The container is denoted as 20.

FIG. 5*a* shows the load receiving means with the spreader 17 already placed in position by way of the crane trolley, the pendulum rods 15 and 16 having been locked by way of the servo-cylinders 180. By lowering the spreader 17 and fitting the container 20 to the spreader 17 the load can be picked up.

FIG. 5*b* shows a first possibility of a mal-alignment. In order to be able to connect the spreader 17 to the container 20 the pendulum rods 15 and 16 must be swung out laterally, which can take place by retracting or extending or releasing the servo-cylinders 180. After coupling the container 20 to the spreader 17 and the slight raising thereof, the pendulum rods are swung again by gravity into the vertical position whereafter the servo-cylinders 180 can be locked.

As apparent from FIG. 5*c* it is also possible to securely couple skew transcontainers 20. When lowering the spreader 17 the latter is deposited on the transcontainer 20 whilst the pendulum rod 15 which is cardanically articulated at its upper end, is moved slightly from the vertical. The servo-cylinder 180 yields likewise.

The arrangement of the servo-cylinders 181 to 184 is shown in FIG. 5*d*. In the case there illustrated, all four pendulum rods 15 and 16 are linked in an articulated manner at their lower end to the first end of a servo-cylinder 181 to 184 the opposite end of which is coupled to the load receiving means 17. The pendulum rods 15, 16 can be released, swung or locked by way of the articulated connection of the servo-cylinders 181 to 184, parallel arrangement of each of the servo-cylinders 181 and 184 respectively 182 and 183 also permitting rotational movements of the spreader 17 in relation to an axis vertical to the drawing plane.

Figure 6B:
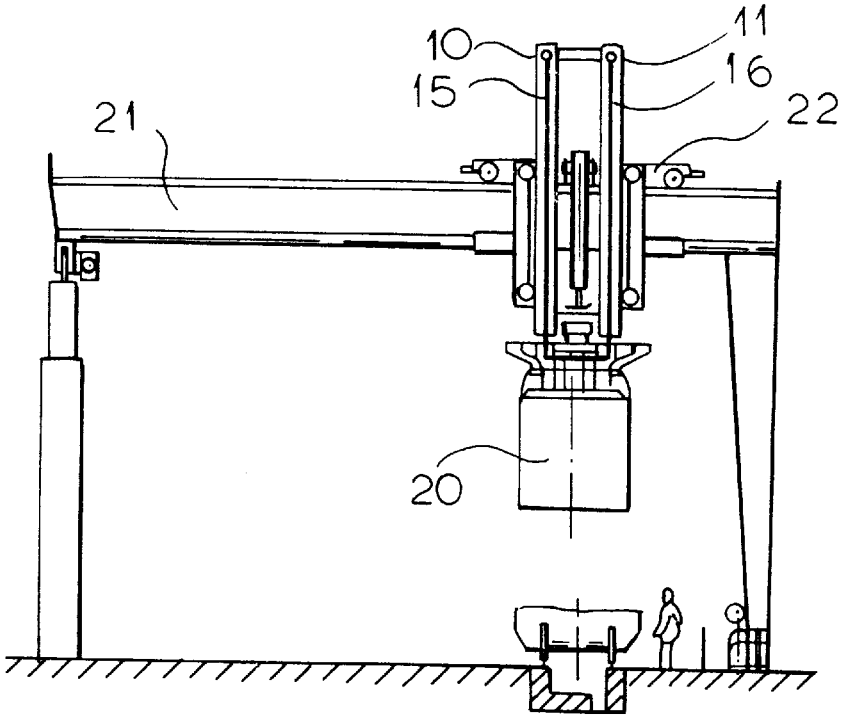

FIGS. 6*a* and 6*b* show on a box beam 21 of a crane a crane trolley 22 to which a lifting structure comprising two columns 10 and 11 is fitted. At the upper end of the lifting structure the pendulum rods 15 and 16 are cardanically suspended. At the lower end, likewise by way of a cardanic suspension, the load receiving means 17 for fixing the container 20 is suspended. In addition, grapple arms 45 are apparent from FIG. 6*a*, by means of which interchangeable containers or semi-trailers can be picked up. These grapple arms 45 are swung upwards in the present case.

The advantages of the servo-cylinders provided for in accordance with the invention reside particularly in that horizontal, vertical as well as pivotal movements of the spreader are made possible. In addition, by virtue of the distance measuring system integrated with the cylinders 180 it is possible to measure the position of the pendulum rods 15 and 16.

Because of their smaller movable masses the servo-cylinders 180 can be positioned more rapidly, easily and exactly than would be possible by moving the crane trolley into alignment. Furthermore a pendulum damping or pendulum rod arrestation in virtually any set positions can be provided by way of the servo-cylinders 180. Finally, it is possible to limit the transverse force of the lifting structures by pressure measurement or pressure limiting valves of the servo-cylinders.

We claim:

1. A transloading apparatus for freight containers, interchangeable containers and semi-containers, comprising:

a horizontally displaceable support spaced above a container to be transloaded and including at least one crane trolley;

at least two vertically elongated rigid lifting structures on said support;

a linear guide system on said support for vertically displacing said lifting structures along a fixed vertical path relative to said support;

a respective pendulum assembly on each of said rigid lifting structures, each of said pendulum assemblies including an elongated member mounted at an upper end of the respective lifting structure and having a lower end capable of swinging relative to the lifting structure; and load receiving means connected to and swingable with said lower ends and provided with formations for engagement with said container and affixing said container detachably to said apparatus.

2. The apparatus defined in claim 1 wherein said elongated members are rods.

3. The apparatus defined in claim 2 wherein each of said rods is connected by a ball joint at its upper end to the respective lifting structure and at its lower end to said load receiving means.

4. The apparatus defined in claim 1 wherein said elongated members are ropes.

5. The apparatus defined in claim 1, further comprising selectively operable arresting means for preventing swinging movement of said load receiving means relative to said lifting structure.

6. The apparatus as defined in claim 5 wherein said arresting means includes a centering pin on one of said load receiving means and said support, and a receiving element engageable by said centering pin on the other of said load receiving means and said support.

7. The apparatus as defined in claim 5 wherein said arresting means includes a respective adjustment unit engaging each of said elongated members.

8. The apparatus as defined in claim 7 wherein said adjustment units are servocylinders.

9. The apparatus as defined in claim 8 wherein at least three of said servocyclinders are provided for positioning said load receiving means relative to said container.

10. The apparatus as defined in claim 1 wherein said lifting structures are provided with separate means for vertically displacing same independently of one another relative to said support.

* * * * *